US010220227B2

(12) United States Patent
Kono

(10) Patent No.: US 10,220,227 B2
(45) Date of Patent: Mar. 5, 2019

(54) FIRE EXTINGUISHING SYSTEM OF AIRCRAFT, AND AIRCRAFT

(71) Applicant: MITSUBISHI AIRCRAFT CORPORATION, Aichi (JP)

(72) Inventor: Takafumi Kono, Aichi (JP)

(73) Assignee: MITSUBISHI AIRCRAFT CORPORATION, Aichi (JP)

( * ) Notice: Subject to any disclaimer, the term of this patent is extended or adjusted under 35 U.S.C. 154(b) by 112 days.

(21) Appl. No.: 14/595,327

(22) Filed: Jan. 13, 2015

(65) Prior Publication Data

US 2015/0202478 A1 Jul. 23, 2015

(30) Foreign Application Priority Data

Jan. 17, 2014 (JP) ..... 2014-006645

(51) Int. Cl.

| | |
|---|---|
| ***A62C 3/08*** | (2006.01) |
| ***B05B 15/62*** | (2018.01) |
| ***A62C 31/28*** | (2006.01) |
| *A62C 35/68* | (2006.01) |

(52) U.S. Cl.

CPC ..... *A62C 3/08* (2013.01); *A62C 31/28* (2013.01); *B05B 15/62* (2018.02); *A62C 35/68* (2013.01)

(58) Field of Classification Search

CPC ..... A62C 3/08; B05B 15/62
USPC ..... 169/69, 54, 62; 248/65; 239/282, 283
See application file for complete search history.

(56) References Cited

U.S. PATENT DOCUMENTS

| | | | | |
|---|---|---|---|---|
| 2,560,091 | A * | 7/1951 | Davis | 169/62 |
| 2,566,235 | A * | 8/1951 | Mathisen | 169/61 |
| 5,040,611 | A * | 8/1991 | Steel | 169/62 |
| 2004/0031887 | A1 * | 2/2004 | Heath | F16L 3/16 248/62 |
| 2010/0252684 | A1 | 10/2010 | Stephen | |
| 2011/0284098 | A1 * | 11/2011 | Silcox | A62C 35/68 137/15.18 |
| 2012/0103638 | A1 * | 5/2012 | Mickelsen et al. | 169/46 |

(Continued)

FOREIGN PATENT DOCUMENTS

| | | | |
|---|---|---|---|
| JP | H10318436 | A | 12/1998 |
| JP | H10318437 | A | 12/1998 |

(Continued)

OTHER PUBLICATIONS

Japanese Office Action for corresponding Japanese Patent Application No. 2014-006645 dated Aug. 24, 2017.

*Primary Examiner* — Steven J Ganey
(74) *Attorney, Agent, or Firm* — Pearne & Gordon LLP

(57) ABSTRACT

A fire extinguishing system of an aircraft, including: a fire extinguishing nozzle device that is provided on an installation member forming a compartment of the aircraft; and a fire extinguishing pipe that is provided on a support structure supporting the installation member from a back side, and supplies a fire extinguishing agent to the fire extinguishing nozzle device. The fire extinguishing pipe is restrained to the support structure at a plurality of restraint positions. A holding device that holds the fire extinguishing pipe and is provided on the support structure is used at at least one of the plurality of restraint positions. The holding device includes a holding section that holds an outer periphery of the fire extinguishing pipe, and a disengaging section that enables disengagement of the fire extinguishing pipe.

15 Claims, 9 Drawing Sheets

(56) References Cited

U.S. PATENT DOCUMENTS

| | | | | |
|---|---|---|---|---|
| 2012/0186835 | A1* | 7/2012 | Meier | 169/46 |
| 2012/0255746 | A1 | 10/2012 | Johnsen et al. | |
| 2012/0305723 | A1* | 12/2012 | Heath | F16B 2/065<br>248/228.1 |
| 2013/0001372 | A1* | 1/2013 | Kara | H02G 3/32<br>248/65 |
| 2013/0187001 | A1 | 7/2013 | Gensch et al. | |

FOREIGN PATENT DOCUMENTS

| | | | |
|---|---|---|---|
| JP | 20105388890 | A | 12/2010 |
| JP | 2011502859 | A | 1/2011 |

* cited by examiner

FIRE EXTINGUISHING SYSTEM OF AIRCRAFT, AND AIRCRAFT

BACKGROUND OF THE INVENTION

Field of the Invention

The present invention relates to a fire extinguishing system including a fire extinguishing pipe that is provided on a support structure supporting, from the back side, an installation member that forms a compartment of an aircraft and where a fire extinguishing nozzle is provided, and an aircraft including the fire extinguishing system.

Description of the Related Art

A compartment, such as a cargo hold, an engine compartment, and an auxiliary power unit compartment, of an aircraft is provided with a fire extinguishing system that injects a fire extinguishing agent from a fire extinguishing nozzle installed on an installation member (liner) forming the compartment in preparation for a fire (U.S. Patent Application Publication No. 2012/0255746).

A fire extinguishing pipe laid on the back side of the installation member is connected to the fire extinguishing nozzle.

The fire extinguishing pipe is restrained to a skeleton that supports the installation member from the back side with a clamp or the like at a plurality of positions in a length direction. The fire extinguishing pipe is thereby restrained at the plurality of positions.

If an article brought into the compartment explodes, a load from a blast is transmitted to the skeleton via the installation member. The load and a restraining force at each of the restraint positions interact with each other, so that relative displacement may be caused at the plurality of positions of the fire extinguishing pipe restrained to the skeleton.

Thus, an object of the present invention is to provide a fire extinguishing system of an aircraft capable of securing a fire extinguishing function without causing damage to a fire extinguishing pipe restrained to a support structure at a plurality of positions upon receiving an excessive stress even when a load from an explosion or the like is transmitted to the support structure via an installation member, and an aircraft including the fire extinguishing system.

SUMMARY OF THE INVENTION

A fire extinguishing system of an aircraft according to the present invention includes: a fire extinguishing nozzle device that is provided on an installation member forming a compartment of the aircraft; and a fire extinguishing pipe that is provided on a support structure supporting the installation member from a back side, and supplies a fire extinguishing agent to the fire extinguishing nozzle device.

The fire extinguishing pipe is restrained to the support structure at a plurality of restraint positions, and a holding device that holds the fire extinguishing pipe and is provided on the support structure is used at at least one of the plurality of restraint positions.

In the present invention, the holding device includes a holding section that holds an outer periphery of the fire extinguishing pipe, and a disengaging section that enables disengagement of the fire extinguishing pipe.

A large load from an explosion or the like is transmitted to the support structure via the installation member. Even when forces in different directions or of different magnitudes are applied to one restraint position and another restraint position due to the load and a restraining force at each of the restraint positions, relative displacement between the two restraint positions is prevented by disengaging the fire extinguishing pipe from the disengaging section of the holding device, and thereby releasing the restriction. Therefore, application of an excessive stress to the fire extinguishing pipe can be avoided.

Consequently, the fire extinguishing pipe is not damaged, and a fire extinguishing function can be secured even after an explosion.

In the fire extinguishing system of the present invention, the disengaging section is preferably formed at a position facing the installation member in the holding device.

Accordingly, the fire extinguishing pipe can be smoothly disengaged toward the installation member from the holding device that is displaced in a direction away from the installation member by following the support structure due to the load from an explosion or the like.

In the fire extinguishing system of the present invention, it is preferable that the holding section includes a first clamp element and a second clamp element that hold the fire extinguishing pipe therebetween, each of the first clamp element and the second clamp element includes an A end fastened by fastening means, and a B end located on an opposite side from the A end, and the disengaging section is formed between the B end of the first clamp element and the B end of the second clamp element.

In the fire extinguishing system of the present invention, the holding section preferably include a cover provided on the first clamp element and the second clamp element, and the cover preferably include an inner peripheral portion covering inner peripheries of the first clamp element and the second clamp element, and an outer peripheral portion provided continuously from the inner peripheral portion to outer peripheral sides of the first clamp element and the second clamp element.

The inner peripheral portion of the cover can protect the fire extinguishing pipe from abrasion or damage when the fire extinguishing pipe is fastened between the first clamp element and the second clamp element or is excited (vibrated).

Since the first and second clamp elements are sandwiched between the outer peripheral portion and the inner peripheral portion of the cover, the cover is held on the clamp without falling off.

In the fire extinguishing system of the present invention, the holding section may be formed in a C shape along the outer periphery of the fire extinguishing pipe, and hold the fire extinguishing pipe by an elastic force.

An aircraft of the present invention includes the above fire extinguishing system.

Here, the above fire extinguishing system may be used for extinguishing a fire in any compartment formed in the aircraft.

Particularly, the fire extinguishing system is preferably used for extinguishing a fire in a cargo hold that is a compartment into which an explosive is likely to be brought under the cover of cargo.

A pipe structure of an aircraft of the present invention is a pipe structure including a pipe that is provided on a support structure supporting, from a back side, an installation member forming a compartment, wherein the pipe is restrained to the support structure at a plurality of restraint positions, a holding device that holds the pipe and is provided on the support structure is used at at least one of the plurality of restraint positions, and the holding device includes a holding section that holds an outer periphery of the pipe, and a disengaging section that enables disengagement of the pipe.

In accordance with the present invention, the same operations and effects as those of the aforementioned fire extinguishing system can be obtained.

In accordance with the present invention, the fire extinguishing function, or a function of a system including the pipe structure can be secured without causing damage to the pipe restrained to the support structure at the plurality of positions upon receiving an excessive stress even when a load from an explosion or the like is transmitted to the support structure of the pipe via the installation member.

BRIEF DESCRIPTION OF THE DRAWINGS

FIG. 4A is a side view; and FIG. 4B is a perspective view;

DETAILED DESCRIPTION OF THE PREFERRED EMBODIMENTS

In the following, an embodiment of the present invention is described by reference to the accompanying drawings.

In the present embodiment, a fire extinguishing system that extinguishes a fire in a cargo hold (cargo room) of an aircraft is described as an example.

[Structure of Fuselage]

Figure 1:
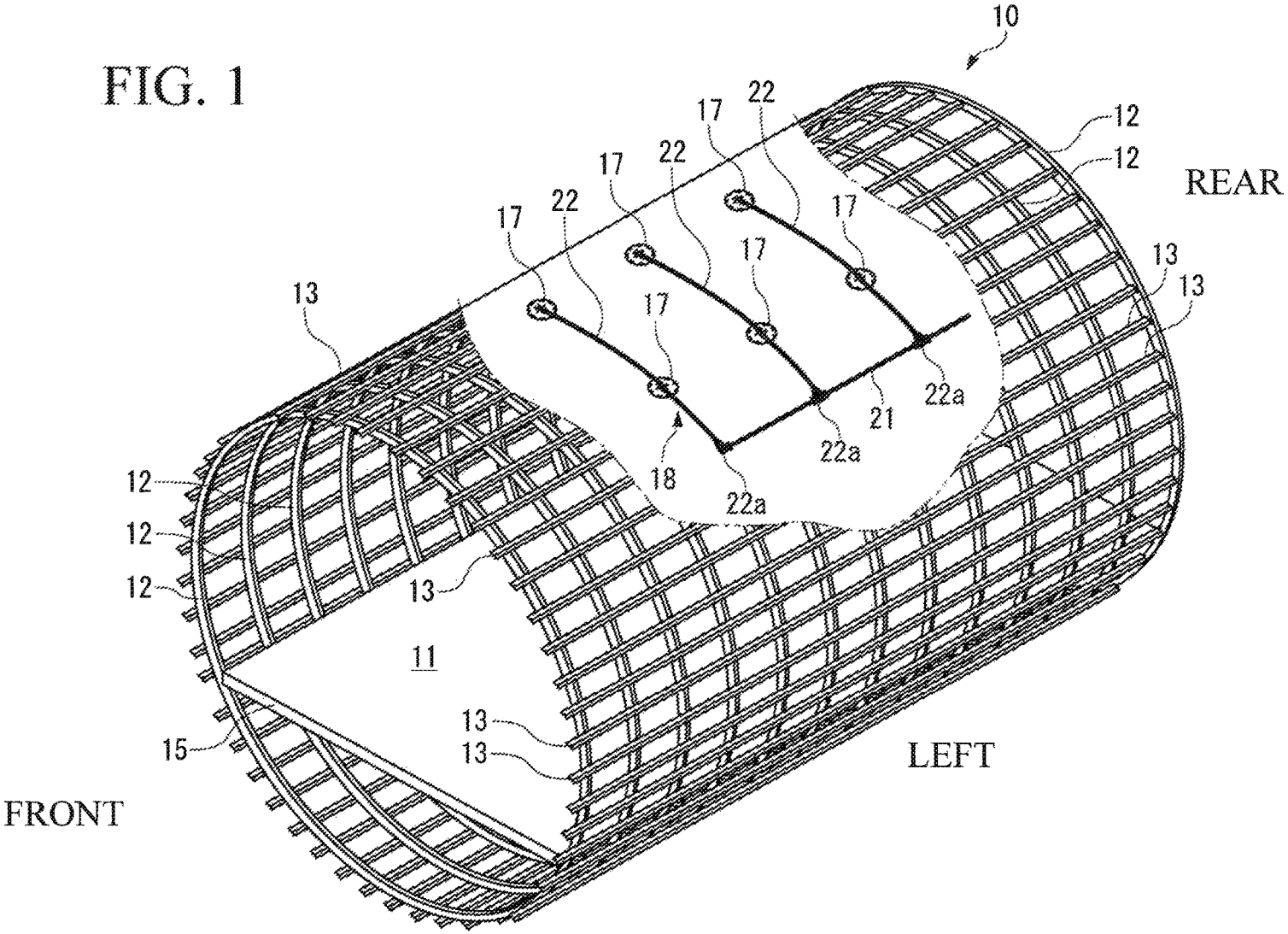
FIG. 1 is a perspective view illustrating the structure of a rear portion of a fuselage of an aircraft where a cargo hold is arranged, and a fire extinguishing system for extinguishing a fire in the cargo hold, according to an embodiment of the present invention.

A cargo hold 11 shown in FIG. 1 is arranged in a rear portion of a cylindrical fuselage of an aircraft.

The fuselage includes a plurality of frames 12 and a plurality of stringers 13 that make up a skeleton of the fuselage, and a skin (not shown) that forms an outer surface of the fuselage.

The frames 12 are formed in a ring shape, and arranged at longitudinal intervals.

The stringers 13 extend in a longitudinal direction perpendicular to the respective frames 12, and provided on the back side of the skin. The stringers 13 are arranged at predetermined intervals on the outer peripheries of the frames 12.

Recessed portions 120 (FIG. 3) for passing the stringers 13 are formed in the outer peripheries of the frames 12. The frames 12 and the stringers 13 are attached to each other in the vicinity of the recessed portions 120.

The frames 12 and the stringers 13 function as a support structure 10 that supports a fire extinguishing pipe 18 described below.

[Liner]

A liner 14 for a wall and a ceiling (FIGS. 2 and 3) of the cargo hold 11 is provided within the support structure 10. The liners are supported by the support structure 10 from their back sides, and form an indoor space (compartment) of the cargo hold 11.

Each of the cargo hold forming members such as the liner 14, a floorboard 15, and bulkheads (not shown) is formed of a material having predetermined fire resistance. The liners of the present embodiment are formed of glass fiber reinforced plastics (GFRP) containing glass fiber. The bulkheads are respectively located at a front end and a rear end of the cargo hold 11.

[Configuration of the Fire Extinguishing System]

Figure 2:
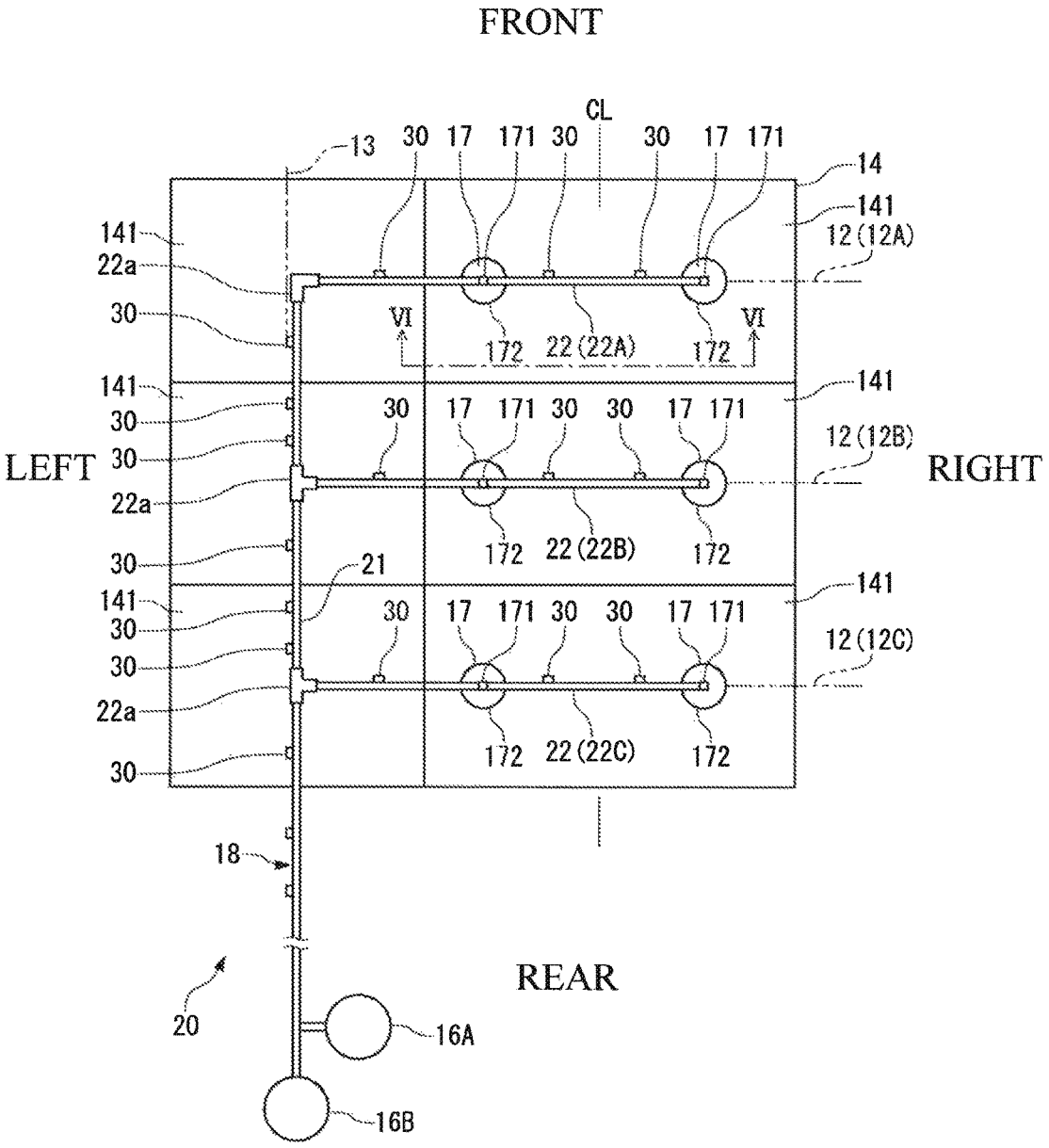
FIG. 2 is a plan view illustrating an installation member and the fire extinguishing system.

As shown in FIG. 2, a fire extinguishing system 20 that extinguishes a fire in the cargo hold 11 includes a high rate discharge bottle 16A and a low rate discharge bottle 16B that serve as a source for supplying a fire extinguishing agent, a plurality of nozzle devices 17 that inject the fire extinguishing agent into the cargo hold 11, and the fire extinguishing pipe 18 that supplies the fire extinguishing agent from the bottles 16A and 16B to the respective nozzle devices 17.

[Bottle]

A halon fire extinguishing agent such as Halon 1301, Halon 1211, and Halon 2402, a hydrofluorocarbon fire extinguishing agent such as HFC-227ea and HFC-23, or the like is enclosed in the high rate discharge bottle 16A and the low rate discharge bottle 16B. The fire extinguishing agent in the high rate discharge bottle 16A has a higher pressure than the fire extinguishing agent in the low rate discharge bottle 16B. The high rate discharge bottle 16A is used for rapidly supplying the fire extinguishing agent so as to extinguish a fire in an early stage. The low rate discharge bottle 16B is used for continuously supplying the fire extinguishing agent for a longer time than that of the high rate discharge bottle 16A so as to complete fire extinction.

The bottles 16A and 16B are installed between an aft pressure bulkhead (not shown) located behind the cargo hold 11, and a firewall (not shown) provided behind the aft pressure bulkhead firewall.

[Nozzle Device]

The number of the nozzle devices 17 is six in the present embodiment. In a ceiling portion of the liner 14, the total of six nozzle devices 17, three in the longitudinal direction and two in a right-left direction, are arranged at predetermined intervals. A center line CL of the ceiling portion (the twelve o'clock position) is set between the nozzle devices 17 located on the left side and the nozzle devices 17 located on the right side.

Each of the nozzle devices 17 includes a nozzle 171 (FIG. 3) that injects the fire extinguishing agent into the cargo hold 11 through an opening formed in the liner 14, and a nozzle pan 172 that is provided on the outer side of the liner 14, and attached to the nozzle 171.

[Fire Extinguishing Pipe]

The fire extinguishing pipe 18 is arranged on the back side of the liner 14. The liner 14 is composed of a plurality of divided panels 141. The panels 141 are installed in an arc shape inside the support structure 10.

The fire extinguishing pipe 18 includes a first pipe 21 that is connected to the bottles 16A and 16B on the rear end side, and extends to the front side along the outer periphery of the liner 14, and a plurality of (here, three) second pipes 22 that branch from the first pipe 21 toward the nozzle devices 17.

The first pipe 21 rises (not shown) along the outer periphery of the liner 14 from the position of the bottles 16A and 16B, and extends to the front side on the left side of the center line CL.

The first pipe 21 extends along the stringer 13 indicated by a two-dot chain line in FIG. 2. The first pipe 21 is supported by the stringer 13 between the adjacent frames 12 and 12. A portion interfering with the frame 12 is formed so as to be bent and pass under the inner side of the frame 12.

On the other hand, each of the second pipes 22 is connected to the first pipe 21 via a joint 22*a*, and extends to the right side perpendicular to the first pipe 21 as shown in FIG. 2. Each of the second pipes 22 is fixed, via a joint, to the nozzles 171 of the two nozzle devices 17 arranged on the right and left sides.

Figure 3:
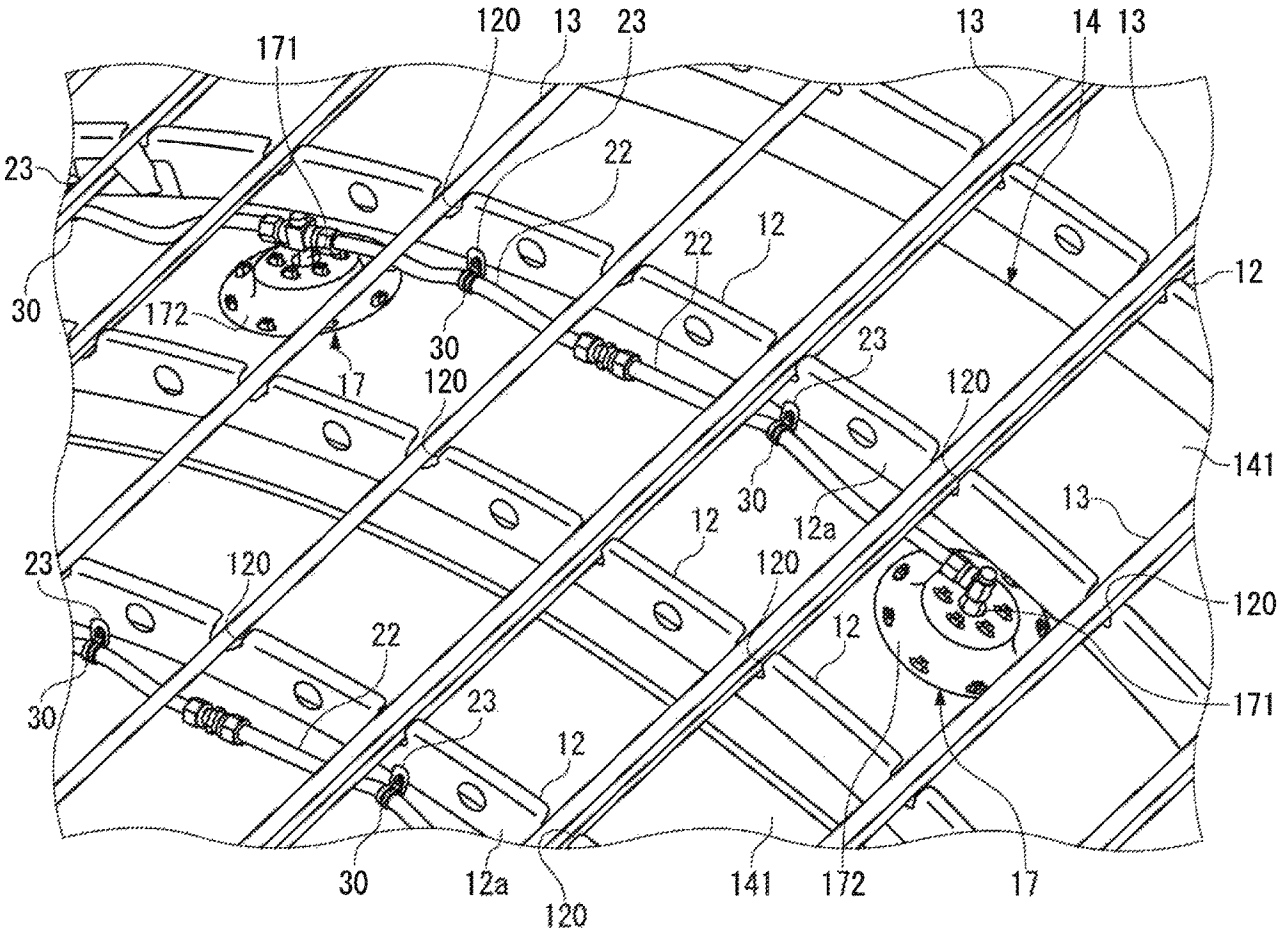
FIG. 3 is a perspective view illustrating a position where a fire extinguishing pipe is supported on frames.

The second pipes 22 extend along the frames 12 indicated by two-dot chain lines in FIG. 2. The second pipes 22 are supported by the frames 12 between the adjacent stringers 13 and 13 as shown in FIG. 3.

The first pipe 21 is restrained to one stringer 13 at a plurality of positions in a length direction.

The second pipe 22 (22A, 22B, 22C) is also restrained to the frame 12 (12A, 12B, 12C) at a plurality of the positions in a length direction.

Moreover, the second pipes 22 are respectively fixed to the nozzles 171.

The positions where the first pipe 21 is restrained, and the positions where the second pipes 22 are restrained are appropriately determined. The pitch of the restraint positions is adjusted to obtain a natural frequency suitable for avoiding resonance.

[Clamp Used at the Restraint Position of the Fire Extinguishing Pipe]

In the present embodiment, a clamp 30 is used at each of the above restraint positions.

In the following, the clamp 30 that restrains the fire extinguishing pipe 18 (here, the second pipe 22) to the frame 12 is described as an example by reference to FIGS. 4A and 4B.

The clamp 30 is fastened to a bracket 23 that is provided on the frame 12, and holds the fire extinguishing pipe 18.

The bracket 23 is formed in a plate-like shape. When fastened to a vertically-extending wall 12*a* of the frame 12 with a rivet 25 or the like, the bracket 23 projects downward from a lower end of the wall 12*a*. A hole 230 is formed in a projecting portion of the bracket 23. A nut 231 corresponding to the hole 230 is provided on the back side of the bracket 23.

A bolt 36 passed through the hole 230 and the nut 231 constitute fastening means for fastening one end side of the clamp 30.

The clamp 30 includes a first clamp element 31, a second clamp element 32, and a cover 33 that is provided on the first and second clamp elements 31 and 32.

The first and second clamp elements 31 and 32 are formed of a material having predetermined strength required for holding the pipe, e.g., metal, resin, and fiber reinforced plastics. The first and second clamp elements 31 and 32 function as a holding section. For example, an alloy material containing iron, an alloy material containing nickel, an alloy material containing iron and nickel; an alloy material containing nickel, iron, and chromium; aluminum alloy; and titanium alloy can be preferably used as the metal material.

The first and second clamp elements 31 and 32 preferably have predetermined heat resistance.

The clamp elements 31 and 32 of the present embodiment are formed of aluminum alloy.

The first clamp element 31 includes an arc holder 31A, and a plate-like tab 31B that is provided continuously from one end side of the holder 31A in a tangential direction of the holder 31A.

The second clamp element 32 as a separate body from the first clamp element 31 includes an arc holder 32A, and a plate-like tab 32B that is provided continuously from one end (A end) side of the holder 32A in a direction crossing a tangential direction of the holder 32A.

With the tabs 31B and 32B, and the other ends (B ends, open ends 38) of the holders 31A and 32A respectively facing each other, the clamp 30 assumes a substantially P shape as a whole.

The cover 33 includes an inner peripheral portion 331 that covers the inner peripheries of the holders 31A and 32A, and an outer peripheral portion 332 that is provided continuously from the inner peripheral portion 331 to the outer peripheral sides of the holders 31A and 32A.

The inner peripheral portion 331 prevents the fire extinguishing pipe 18 from being fastened and damaged between the holders 31A and 32A.

The inner peripheral portion 331 is provided on an almost entire inner peripheral surface excluding a gap between the open end 38 of the holder 31A and the open end 38 of the holder 32A.

A substantially circular slot 37 for passing the fire extinguishing pipe 18 is formed inside the inner peripheral portion 331.

The outer peripheral portion 332 is provided continuously from the inner peripheral portion 331 to the outer peripheral sides of the holders 31A and 32A. The outer peripheral portion 332 and the inner peripheral portion 331 sandwich the holders 31A and 32A therebetween.

The outer peripheral portion 332 is provided on the both widthwise sides of the holders 31A and 32A.

The cover 33 is formed of a polymer material, such as resin and rubber, having predetermined flexibility. For example, EPR (ethylene-propylene rubber), nitrile rubber, chloroprene rubber, silicone rubber, fluorosilicone rubber, and PTFE (polytetrafluoroethylene) can be preferably used as the polymer material.

The cover 33 preferably has predetermined heat resistance.

The cover 33 is composed of two pieces: a piece corresponding to the first clamp element 31, and a piece corresponding to the second clamp element 32. The cover 33 is thus easily fitted to the clamp 30.

The cover 33 is not limited to a member formed separately from the clamp elements 31 and 32, and may be a film coated on the clamp elements 31 and 32.

When the fire extinguishing pipe 18 is held by the clamp 30, the fire extinguishing pipe 18 is passed through the slot 37 of the cover 33 fitted to the first clamp element 31 and the second clamp element 32. Alternatively, the existing fire extinguishing pipe 18 is sandwiched between the first clamp element 31 and the second clamp element 32 where the cover 33 has not been fitted, and the respective pieces of the cover 33 are fitted to the first clamp element 31 and the second clamp element 32.

The bolt 36 is then passed through holes 35 formed in the tabs 31B and 32B, and the hole 230 in the bracket 23. When the nut 231 and the bolt 36 on the back side of the bracket 23 are tightened, the fire extinguishing pipe 18 is fastened by the first and second clamp elements 31 and 32, and restrained between the holders 31A and 32A.

At this time, the open end 38 of the first clamp element 31 and the open end 38 of the second clamp element 32 are located at a lower end of the clamp 30, and face the liner 14.

In some cases, a force for causing relative displacement between the fire extinguishing pipe 18 held in the slot 37 of the clamp 30, and the frame 12 or the stringer 13 supporting the fire extinguishing pipe 18 may be applied. When the force is an excessive force exceeding a force applied in laying, replacement, and maintenance of the fire extinguishing pipe 18, or a force applied during operation of the aircraft (cruising, takeoff, landing or the like), the clamp 30 releases the restriction of the fire extinguishing pipe 18 by disengaging the fire extinguishing pipe 18 from the gap between the open end 38 of the first clamp element 31 and the open end 38 of the second clamp element 32 (a disengaging section) as described below.

[Fire Extinction in the Cargo Hold]

The fire extinguishing system 20 of the present embodiment is automatically activated when the outbreak of a fire in the cargo hold 11 is detected by a fire detection system (not shown).

The fire extinguishing system 20 first opens a valve of the high rate discharge bottle 16A, and rapidly supplies the fire extinguishing agent to the respective nozzle devices 17 through the fire extinguishing pipe 18. Subsequently, the fire extinguishing system 20 opens a valve of the low rate discharge bottle 16B, and continues to supply the fire extinguishing agent to the respective nozzle devices 17.

By injecting the fire extinguishing agent from the nozzles 171 of the nozzle devices 17, the density of the fire extinguishing agent in the cargo hold 11 is increased, and a combustion reaction is inhibited by the fire extinguishing agent, so that the fire is extinguished.

[Protection from Explosion]

By the way, an explosive may be brought into the cargo hold 11 under the cover of cargo. When the explosive explodes, an impact load from a blast is applied to the liner 14. The load is applied in a direction to press up the liner 14 from the radially inner side to the outer side of the cargo hold 11 as indicated by arrows in FIG. 6, and is also transmitted to the support structure 10 that supports the liner 14.

Here, forces in different directions or of different magnitudes may be applied to the respective restraint positions of the fire extinguishing pipe 18 due to a correlation between the load in the explosion and a restraining force for restraining the fire extinguishing pipe 18 to the support structure 10 or the liner 14.

In this case, the clamp 30 releases the restriction of the fire extinguishing pipe 18 so as to avoid application of an excessive stress to the fire extinguishing pipe 18 with relative displacement caused between two or more restraint positions.

Figure 5:
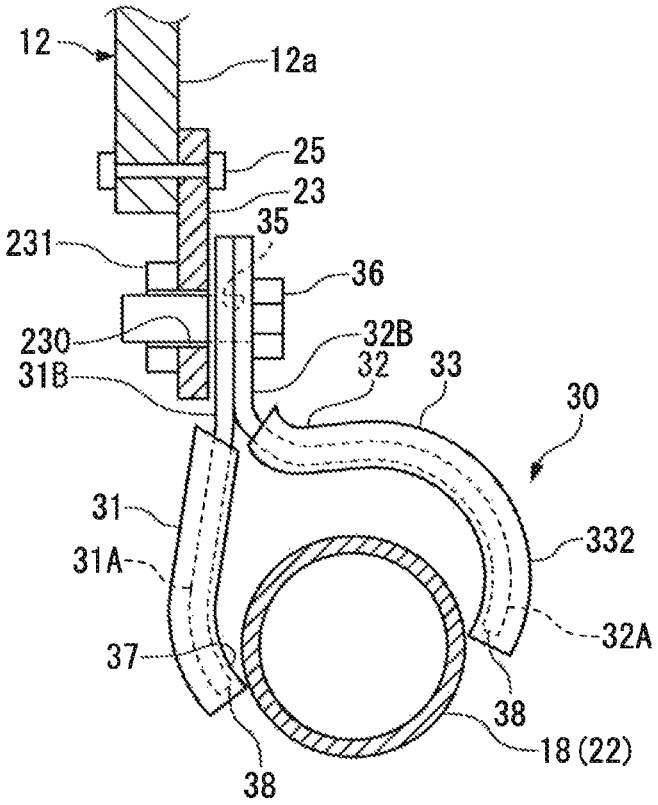
FIG. 5 is a side view illustrating a state in which the fire extinguishing pipe is disengaged from the clamp.

A position where the second pipe 22 is restrained to the frame 12 is described as an example by reference to FIG. 5.

It is assumed that the load in the explosion is applied in a direction to displace the frame 12 upward at the restraint position shown in FIG. 5, while a force for keeping the second pipe 22 at the position is applied by the restraining force at another restraint position. For example, the another restraint position is a position where the first pipe 21 connected to the second pipe 22 is restrained to the stringer 13 by the clamp 30. The another restraint position may also be a position where the second pipe 22 is fixed to the nozzle 171 to which the nozzle pan 172 provided on the liner 14 is attached.

When the above forces are applied, the holders 31A and 32A are deformed in a direction in which the open ends 38 and 38 of the clamp 30 separate from each other. The second pipe 22 held in the slot 37 is disengaged downward from the gap between the open ends 38 and 38. The restriction of the second pipe 22 by the clamp 30 is thereby released, so that application of an excessive stress to the second pipe 22 and the first pipe 21 connected to the second pipe 22 can be avoided.

At a position where the first pipe 21 is restrained to the stringer 13, the holders 31A and 32A are deformed, and the first pipe 21 held in the slot 37 is disengaged downward from the gap between the open ends 38 and 38 similarly to the above configuration. Thus, relative displacement between two or more restraint positions is prevented, and application of an excessive stress to the first pipe 21 and the second pipe 22 can be avoided.

Accordingly, the fire extinguishing pipe 18 is not bent or broken, and a fire extinguishing function can be secured even after the explosion.

Therefore, a fire that could occur after the explosion can be effectively handled.

In the present embodiment, the clamp 30 capable of disengaging the fire extinguishing pipe 18 is used at each of the plurality of restraint positions of the fire extinguishing pipe 18. Therefore, even when an excessive force for displacing the frame 12 or the stringer 13 with respect to the fire extinguishing pipe 18 is generated at any restraint position of the fire extinguishing pipe 18, application of an excessive stress to the fire extinguishing pipe 18 can be avoided by releasing the restriction of the fire extinguishing pipe 18 by the clamp 30 as described above.

Figure 6:
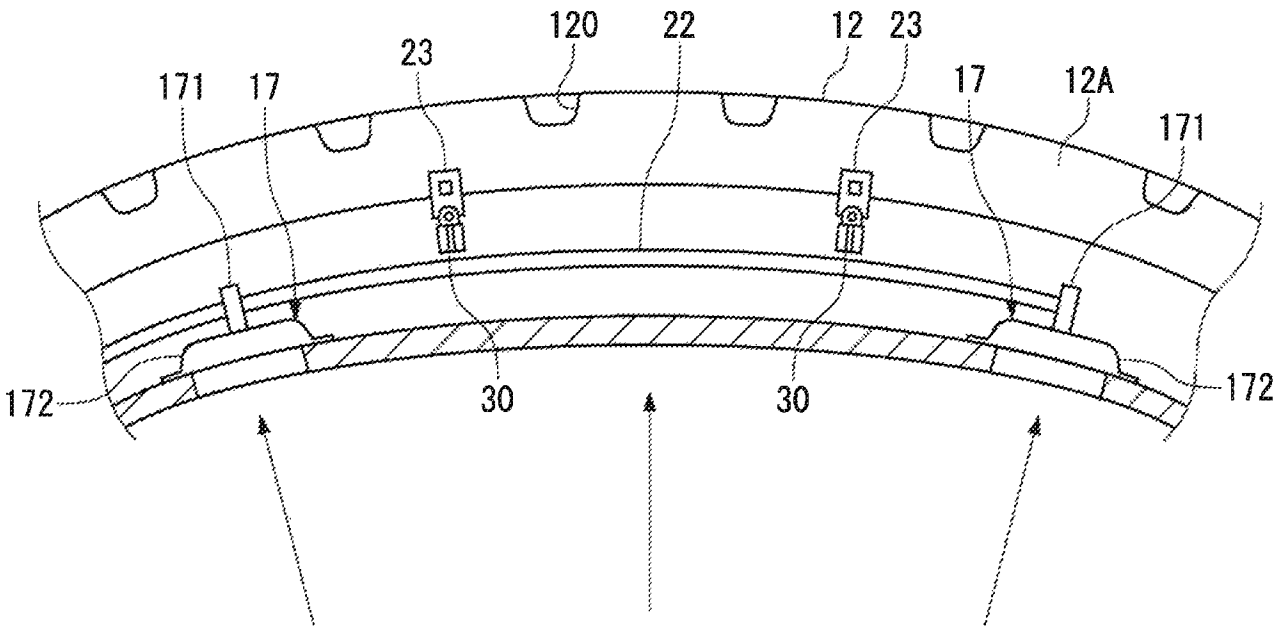
FIG. 6 is a sectional view along a line VI-VI in FIG. 2.

The fire extinguishing pipe 18 disengaged from the clamp 30 is supported by the stringer 13 or the frame 12 at a restraint position different from the disengaged position. The fire extinguishing pipe 18 is also supported by the liner 14 via the nozzle 171 and the nozzle pan 172 (FIG. 6).

Figure 4A:
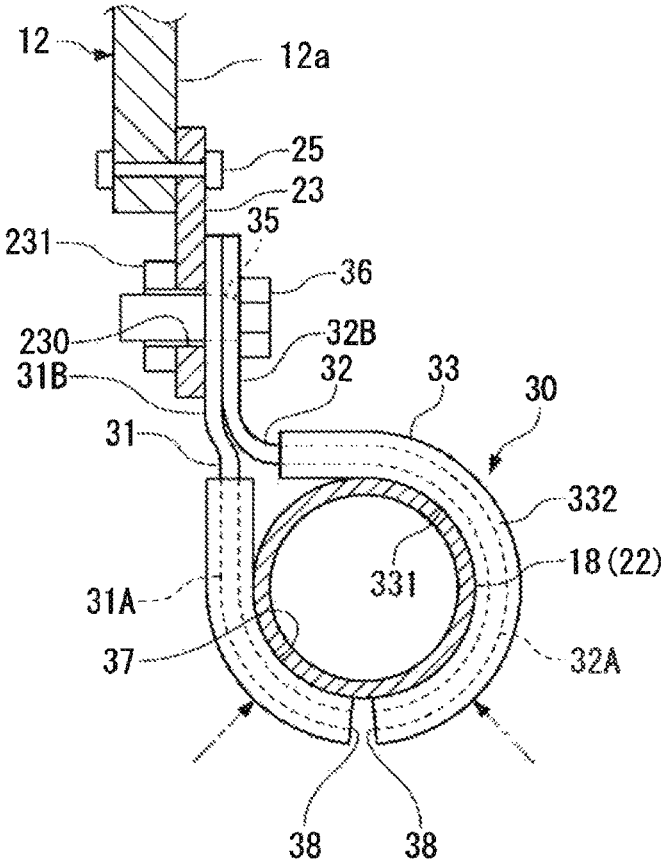
FIGS. 4A and 4B are views illustrating a clamp for supporting the fire extinguishing pipe on a frame or a stringer.
Figure 4B:
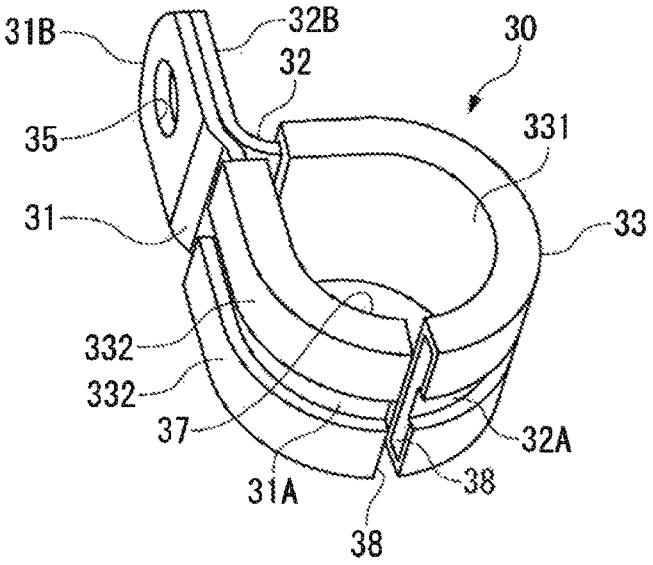

In the present embodiment, as shown in FIG. 4A, the open ends 38 and 38 of the first and second clamp elements 31 and 32 are located at the lower end of the clamp 30, and face the liner 14. Thus, the fire extinguishing pipe 18 can be smoothly disengaged toward the liner 14 from the clamp 30 that is displaced in a direction away from the liner 14 by following the frame 12 or the stringer 13 due to the load in the explosion.

However, the positions of the open ends 38 and 38 may be also set at a position shifted to one side from the lower end of the clamp 30 or a position shifted to the other side as indicated by the one-dot chain arrows in FIG. 4A. Even in this case, the fire extinguishing pipe 18 can be disengaged toward the liner 14 from the clamp 30 that is displaced by following the frame 12 or the stringer 13.

The modulus of elasticity of the first and second clamp elements 31 and 32, the dimension of the gap between the open ends 38 and 38, or the like are appropriately set so as not to disengage the fire extinguishing pipe 18 from the clamp 30 by a load applied to the fire extinguishing pipe 18 at the time of maintenance or during operation, but so as to reliably disengage the fire extinguishing pipe 18 from the clamp 30 at the time of explosion.

Although the clamp 30 of the present embodiment disengages the fire extinguishing pipe 18 by plastic deformation of the first and second clamp elements 31 and 32 in the explosion, a clamp that is deformed within the range of an elastic region to disengage the fire extinguishing pipe 18 may be also employed.

In accordance with the present embodiment, the fire extinguishing function can be secured only by configuring the clamp 30 so as to disengage the fire extinguishing pipe 18 when an excessive force is applied at the time of explosion or the like, without adding a bellows, an elastic member or the like for absorbing relative displacement between the stringer 13 or the frame 12 and the fire extinguishing pipe 18 to the fire extinguishing pipe 18. Therefore, the weight, the cost or the like of the fire extinguishing system 20 can be reduced as compared to a case in which displacement absorbing means such as a bellows and an elastic member is provided.

Unlike in the above embodiment, the above clamp 30 may be employed at only some of the plurality of restraint positions where the fire extinguishing pipe 18 is restrained to the stringer 13 or the frame 12.

In this case, the clamp 30 is preferably used at a restraint position where an excessive force for causing relative displacement between the fire extinguishing pipe and the support structure tends to be generated based on an analysis result of the load in the explosion and the restraining force at each of the restraint positions by tests or simulations. A normal clamp that does not disengage the fire extinguishing pipe 18 can be used at the remaining restraint positions.

Figure 7A:
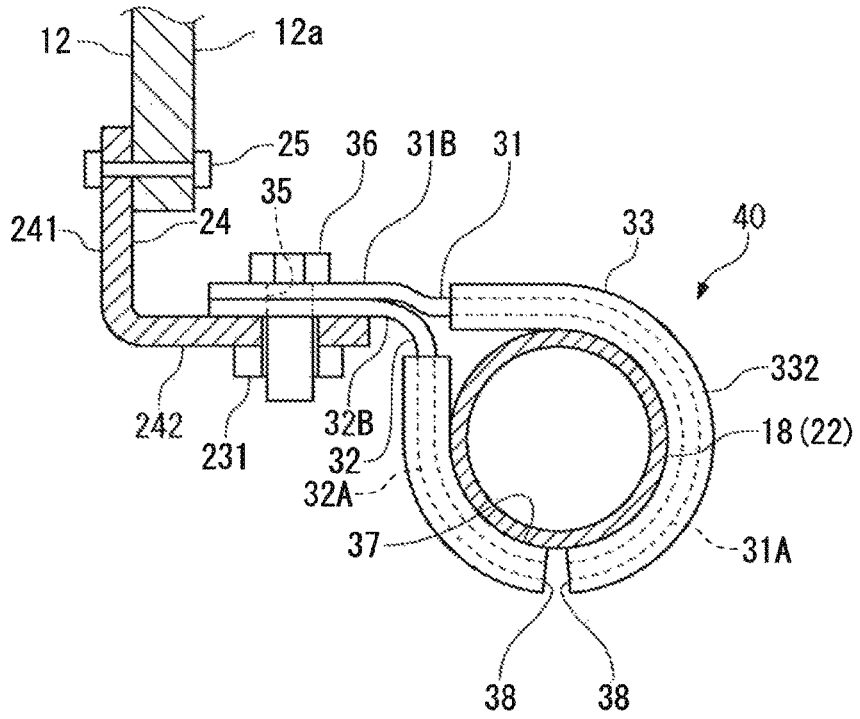
FIG. 7A is a view illustrating another form of the clamp and a bracket.

FIG. 7A shows another form of the clamp and the bracket.

A clamp 40 is fastened to an L-shaped bracket 24 that is provided on the frame 12 or the stringer 13.

The bracket 24 has a first piece 241 that is provided on the vertically-extending wall 12*a* of the frame 12 or the stringer 13, and a second piece 242 that is bent from the first piece 241 and extends in a horizontal direction.

The clamp 40 has a different circumferential length ratio between the holders 31A and 32A from that of the above clamp 30. When the tabs 31B and 32B of the clamp 40 are fastened to the second piece 242 of the bracket 24 with the bolt 36, the open ends 38 and 38 of the holders 31A and 32A are located at the lower end of the clamp 40, and face the liner 14.

Therefore, when the frame 12 or the stringer 13 is displaced in a direction away from the liner 14, the fire extinguishing pipe 18 can be smoothly disengaged toward the liner 14 from the clamp 40 following the frame 12 or the stringer 13.

A clamp and a bracket having an appropriate form can be used according to a positional relationship between the stringer 13 or the frame 12 and the fire extinguishing pipe 18.

The bracket may be used when necessary. The tabs of the clamps 30 and 40 may be fixed to the wall 12*a* of the frame 12 or the wall of the stringer 13 with a bolt or a rivet.

The first pipe 21 and the second pipes 22 can be arranged in any manner.

Figure 7B:
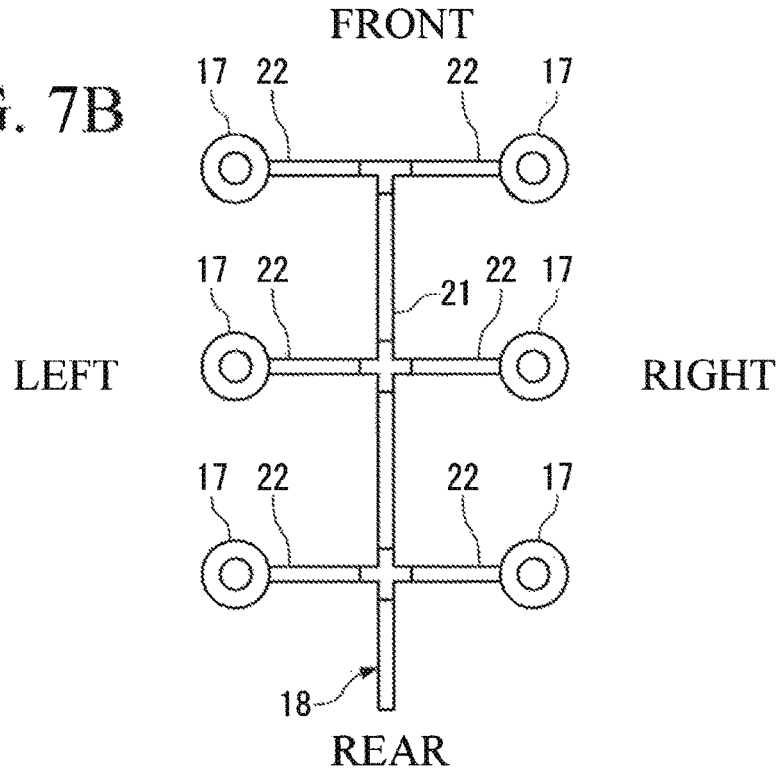
FIG. 7B is a view illustrating a modification of the fire extinguishing pipe.

For example, the second pipes 22 may be connected to the both right and left sides of the first pipe 21 as shown in FIG. 7B.

The fire extinguishing pipe 18 may also include two or more first pipes 21.

The present invention can be applied to a fire extinguishing system for a cargo hold that is arranged below a cabin of an aircraft.

The present invention can be also applied to fire extinguishing systems for various compartments provided in an aircraft, such as an engine compartment that accommodates an engine of the aircraft, and an auxiliary power unit compartment that accommodates an auxiliary power unit, in addition to the cargo holds of the aircraft.

Furthermore, the present invention is not limited to the aircraft, and can be also applied to fire extinguishing systems for various compartments in, for example, ships, trains, and buildings.

Moreover, the present invention is not limited to the fire extinguishing system, and can be also applied to a system in which a pipe accompanying various systems is supported by a support structure with a clamp. The pipe may be a pipe used as a case for accommodating a cable.

Any form may be employed for the clamp in the present invention as long as the clamp functions to hold the pipe by fastening the pipe between the first clamp element and the second clamp element, and the disengaging section that enables disengagement of the fire extinguishing pipe when a force exceeding a predetermined magnitude for causing relative displacement between the fire extinguishing pipe held in the clamp and the support structure is applied is formed. The material of the clamp is not limited as long as the material has necessary strength for holding the pipe, and has properties such as heat resistance required according to the use of the system and installation conditions.

For example, the first clamp element 31 and the second clamp element 32 may be continuously provided on the side fastened by the fastening means.

The positions of the open ends 38 of the first clamp element 31 and the second clamp element 32 may be shifted in a direction perpendicular to the paper face of FIG. 4, and the open ends 38 may overlap in a circumferential direction of the clamp.

Figure 8B:
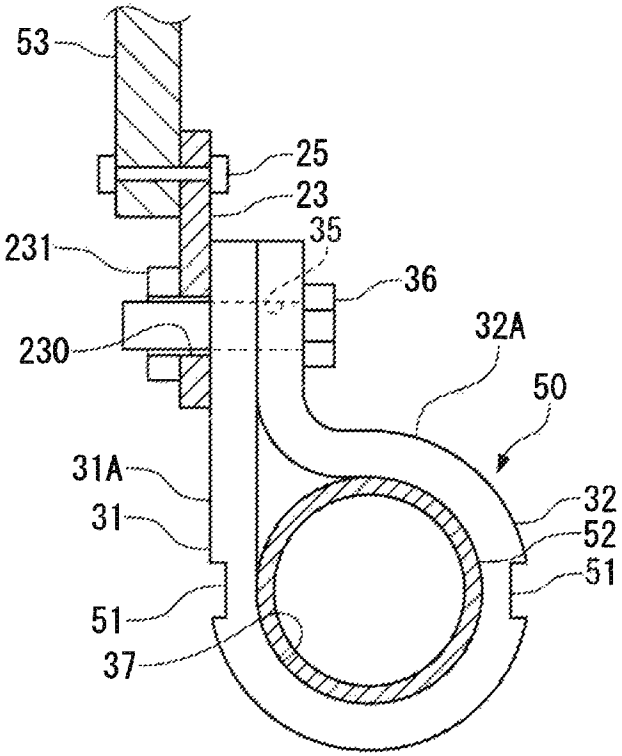
FIGS. 8A and 8B are views illustrating a holding device (clamp) of the present invention.
Figure 8A:
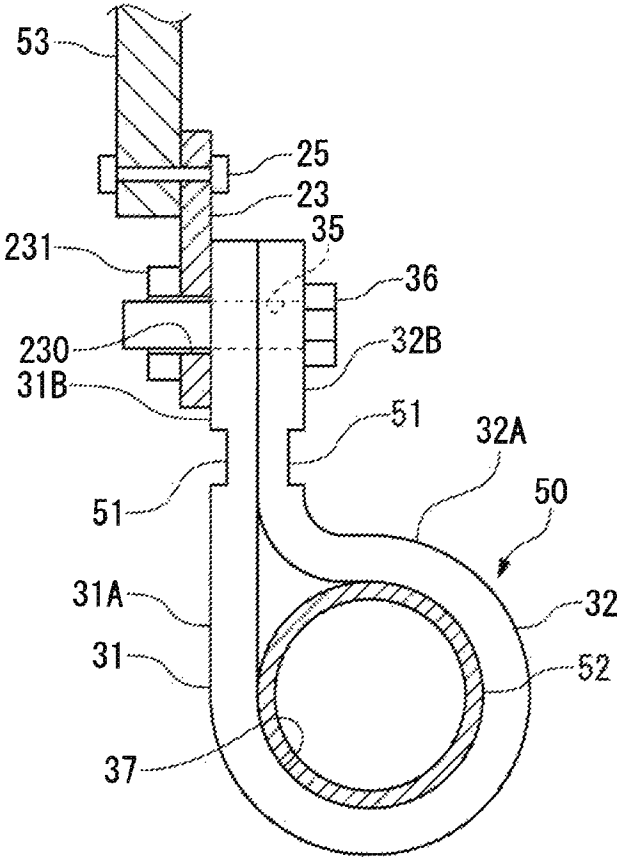

In the present invention, clamps 50 formed of a resin material as shown in FIGS. 8A and 8B may be also employed. Both of the clamps 50 in FIGS. 8A and 8B include the first clamp element 31 and the second clamp element 32.

In the clamp 50 shown in FIG. 8A, the holder 31A and the tab 31B of the first clamp element 31 are coupled by a thin-walled portion 51 as the disengaging section. Similarly, the holder 32A and the tab 32B of the second clamp element 32 are coupled by a thin-walled portion 51 as the disengaging section. The thin-walled portions 51 are formed in a portion extending along the vertical direction in the clamp 50.

In the clamp 50 shown in FIG. 8B, a thin-walled portion 51 as the disengaging section is formed in a portion extending substantially along the vertical direction in the holder 31A of the first clamp element 31. Similarly, a thin-walled portion 51 as the disengaging section is formed in a portion extending substantially along the vertical direction in the holder 32A of the second clamp element 32.

When an excessive force for relatively displacing a support structure 53 with respect to a pipe 52 held by the clamp 50 in FIG. 8A or the clamp 50 in FIG. 8B is upwardly applied, and a force for keeping the pipe 52 at the position is applied by another clamp or the like, a tensile force is applied vertically, so that the thin-walled portions 51 fracture. The pipe 52 is thereby disengaged.

When the thin-walled portion 51 is arranged along a direction in which the force for causing relative displacement between the support structure 53 and the pipe 52 is applied, the fracture is mainly caused by the tensile force. As a result, a force for holding the pipe 52 and a force for causing fracture can be easily controlled to desired strength as compared to a case in which the thin-walled portion 51 is provided at the lower end position of the clamp 50, and the thin-walled portion 51 fractures by multiple forces including shearing and tensile forces.

Figure 9:
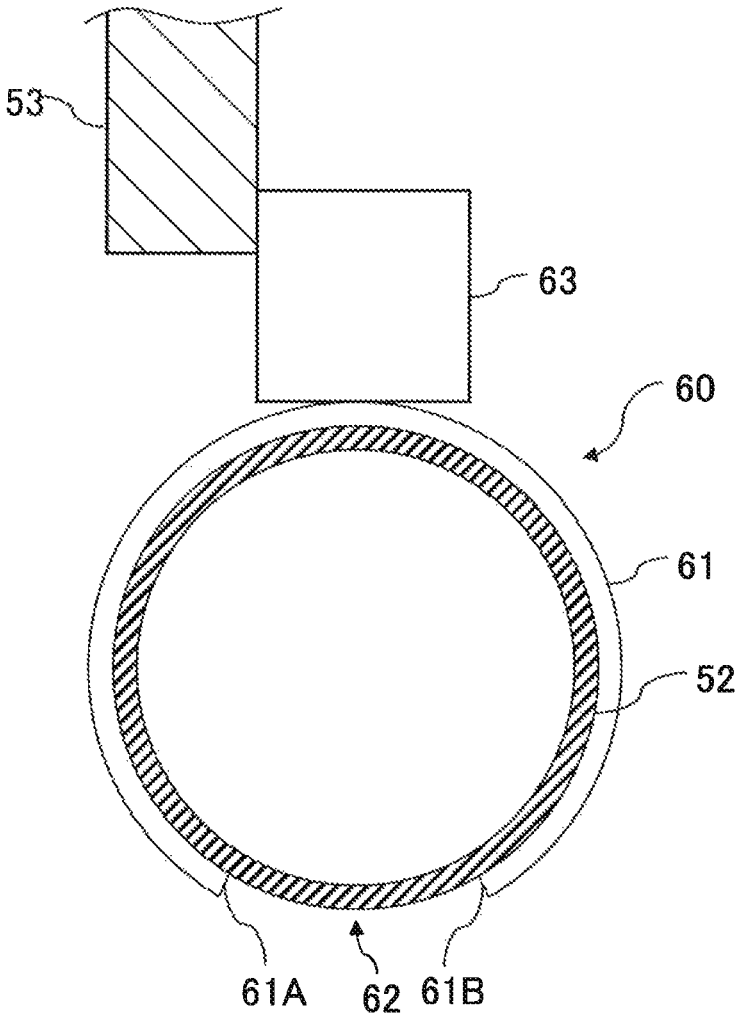
FIG. 9 is a view illustrating a holding device (clamp) of the present invention.

A holding device 60 shown in FIG. 9 may be also used instead of the aforementioned clamps 30, 40, and 50.

The holding device 60 includes a C-shaped holding section 61 that holds the outer periphery of the pipe 52, and a disengaging section 62 that enables disengagement of the pipe 52.

The holding section 61 is formed of metal or resin having spring properties, and holds the pipe 52 by its elastic force.

The holding section 61 is attached to the support structure 53 by an attachment section 63, which contacts an upper end of the holding section 61.

The holding section 61 downwardly extends in an arc shape to the both sides from the position of the attachment section 63.

A cover member or a film formed of resin may be provided on the inner periphery and the outer periphery of the holding section 61. It is particularly preferable to provide the cover member or the film on the inner peripheral side so as to protect the pipe 52 from abrasion and damage.

The disengaging section 62 is located between both ends (open ends 61A and 61B) of the holding section 61.

When an excessive force for relatively displacing the support structure 53 with respect to the pipe 52 held by the holding device 60 is applied, the holding section 61 is plastically deformed or elastically deformed in a direction in which the open ends 61A and 61B separate from each other, and the pipe 52 held within the holding section 61 is disengaged downward from the gap between the open ends 61A and 61B. The restriction of the pipe 52 by the holding device 60 is thereby released, so that application of an excessive stress to the pipe 52 or a pipe or the like connected to the pipe 52 can be avoided.

Since the holding device 60 is simply composed of one component (the holding section 61), the weight and the number of assembling steps can be advantageously reduced.

The constitutions described in the aforementioned embodiment may be also freely selected or appropriately changed into other constitutions without departing from the gist of the present invention.

What is claimed is:

1. A fire extinguishing system of an aircraft, comprising:

a fire extinguishing nozzle device that is provided on an installation member forming a compartment of the aircraft; and a fire extinguishing pipe that is provided on a support structure supporting the installation member from a back side, and supplies a fire extinguishing agent to the fire extinguishing nozzle device, wherein the fire extinguishing pipe is restrained to the support structure at a plurality of restraint positions, a holding device that holds the fire extinguishing pipe and is provided on the support structure is used at at least one of the plurality of restraint positions, and the holding device includes a holding section that extends at least partially around an outer periphery of the fire extinguishing pipe, and a disengaging section provided to the holding section, at least one of the holding section and the disengaging section configured to deform to enable disengagement of the fire extinguishing pipe from the holding section in response to exposure of the support structure to an external force applied at a time of an explosion, the external force causing relative displacement between the fire extinguishing pipe and the support structure, wherein the holding section is configured to disengage the fire extinguishing pipe from the holding device when exposed to the external force at the time of the explosion, while not disengaging the fire extinguishing pipe from the holding device by a load applied to the fire extinguishing pipe at the time of maintenance or during operation of the aircraft, and wherein the external force applied at the time of the explosion is greater than the load applied to the fire extinguishing pipe at the time of maintenance or during operation of the aircraft.

2. The fire extinguishing system of an aircraft according to claim 1, wherein the disengaging section is formed at a position facing the installation member in the holding device.

3. The fire extinguishing system of an aircraft according to claim 1, wherein the holding device is a clamp.

4. The fire extinguishing system of an aircraft according to claim 1, wherein the holding section includes a first clamp element and a second clamp element that hold the fire extinguishing pipe therebetween, each of the first clamp element and the second clamp element includes an A end fastened by fastening means, and a B end located on an opposite side from the A end, and the disengaging section is formed between the B end of the first clamp element and the B end of the second clamp element.

5. The fire extinguishing system of an aircraft according to claim 4, wherein a modulus of elasticity of the first and second clamp elements, and a dimension of a gap between the B ends are set so as to disengage the fire extinguishing pipe from the holding device at the time of explosion, while they are set so as not to disengage the fire extinguishing pipe from the holding device by the load applied to the fire extinguishing pipe at the time of maintenance or during operation of the aircraft.

6. The fire extinguishing system of an aircraft according to claim 4, wherein the holding section further includes a cover provided on the first clamp element and the second clamp element.

7. The fire extinguishing system of an aircraft according to claim 6, wherein the cover includes an inner peripheral portion covering inner peripheries of the first clamp element and the second clamp element, and an outer peripheral portion provided continuously from the inner peripheral portion to outer peripheral sides of the first clamp element and the second clamp element.

8. The fire extinguishing system of an aircraft according to claim 1, wherein the holding device is formed of a resin material and comprises a thin-walled portion as the disengaging section.

9. The fire extinguishing system of an aircraft according to claim 1, wherein the holding section is formed in a C shape along the outer periphery of the fire extinguishing pipe, and holds the fire extinguishing pipe by an elastic force.

10. The fire extinguishing system of an aircraft according to claim 1, wherein the holding device is composed of one component.

11. An aircraft comprising the fire extinguishing system of an aircraft according to claim 1.

12. The aircraft according to claim 11, wherein the compartment is a cargo hold that accommodates cargo.

13. The fire extinguishing system of an aircraft according to claim 1, wherein the disengaging section is configured to enable disengagement of the fire extinguishing pipe without damaging the fire extinguishing pipe to an extent that would interfere with a fire extinguishing capability of the fire extinguishing system.

14. A fire extinguishing system of an aircraft, comprising:

a fire extinguishing nozzle device that is provided on an installation member forming a compartment of the aircraft; and a fire extinguishing pipe that is provided on a support structure supporting the installation member from a back side, and supplies a fire extinguishing agent to the fire extinguishing nozzle device, wherein the fire extinguishing pipe is restrained to the support structure at a plurality of restraint positions, a holding device that holds the fire extinguishing pipe and is provided on the support structure is used at at least one of the plurality of restraint positions, and the holding device includes a holding section that extends at least partially around an outer periphery of the fire extinguishing pipe, and a disengaging section provided to the holding section, at least one of the holding section and the disengaging section configured to deform to enable disengagement of the fire extinguishing pipe from the holding section in response to exposure of the support structure to an external force, the external force causing relative displacement between the fire extinguishing pipe and the support structure, wherein the holding section includes a first clamp element and a second clamp element that hold the fire extinguishing pipe therebetween, each of the first clamp element and the second clamp element includes an A end fastened by fastening means, and a B end located on an opposite side from the A end, and the disengaging section is formed between the B end of the first clamp element and the B end of the second clamp element, and wherein the disengaging section disengages the fire extinguishing pipe by plastic deformation of the first clamp element and the second clamp element.

15. A pipe structure of an aircraft comprising a pipe that is provided on a support structure supporting, from a back side, an installation member forming a compartment of the aircraft, wherein the pipe is restrained to the support structure at a plurality of restraint positions, a holding device that holds the pipe and is provided on the support structure is used at at least one of the plurality of restraint positions, and the holding device includes a holding section that extends at least partially around an outer periphery of the pipe, and a disengaging section provided to the holding section, at least one of the holding section and the disengaging section configured to deform to enable disengagement of the pipe from the holding section in response to exposure of the support structure to an external force applied at a time of an explosion, the external force causing relative displacement between the pipe and the support structure, wherein the holding section is configured to disengage the fire extinguishing pipe from the holding device when exposed to the external force at the time of the explosion, while not disengaging the fire extinguishing pipe from the holding device by a load applied to the fire extinguishing pipe at the time of maintenance or during operation of the aircraft, and wherein the external force applied at the time of the explosion is greater than the load applied to the fire extinguishing pipe at the time of maintenance or during operation of the aircraft.

* * * * *